United States Patent [19]

Zuckerman et al.

[11] 4,438,874

[45] Mar. 27, 1984

[54] UNITARY GARMENT HANGER SYSTEM

[76] Inventors: Jack M. Zuckerman; Andrew M. Zuckerman, both of 110-11 Queens Blvd., Forest Hills, N.Y. 11375

[21] Appl. No.: 295,111

[22] Filed: Aug. 21, 1981

[51] Int. Cl.[3] ..... A47J 51/084; A47J 51/097

[52] U.S. Cl. ..... 223/88; 223/91; 223/93

[58] Field of Search ..... 223/89, 90, 91, 93, 223/94, 85, 87, 92, 88; D6/254

[56] References Cited

U.S. PATENT DOCUMENTS

| | | | |
|---|---|---|---|
| 2,804,245 | 8/1957 | Biondolillo et al. | 223/90 |
| 2,822,967 | 2/1958 | Spitz | 223/88 |
| 3,165,245 | 1/1965 | Levine et al. | 223/91 |
| 3,225,978 | 12/1965 | Wach | 223/91 |
| 3,307,753 | 3/1967 | Levine et al. | 223/95 |
| 3,445,045 | 5/1969 | Panning | 223/95 |
| 3,477,623 | 11/1969 | Milette et al. | 223/88 |
| 4,023,762 | 5/1977 | Batts et al. | 223/85 X |
| 4,129,218 | 12/1978 | Koellner | 223/88 |

FOREIGN PATENT DOCUMENTS

| | | | |
|---|---|---|---|
| 2058001 | 4/1981 | United Kingdom | 223/89 |

*Primary Examiner*—Robert Mackey

*Attorney, Agent, or Firm*—Bauer & Amer

[57] ABSTRACT

A unitary garment hanger system fabricated in monolithic form in a single molding step to include a plurality of relatively spaced hanger elements that are formed unitary with and integrally connected by struts that join the hanger elements together for articulation between selected positions on opposite sides of each other and at relatively different heights for the attractive individual display of garments supported thereon.

17 Claims, 8 Drawing Figures

UNITARY GARMENT HANGER SYSTEM

The present invention relates to garment hangers. More particularly it relates to a garment hanger system which includes a plurality of individual garment hanger elements each forming an integral part of a singular, unitary garment hanger system. The garment hanger elements are joined together in a monolithic arrangement by connecting struts that enable the hanger elements to be articulated to selected relative positions of adjustment for the display of garments thereon and by the present system.

In the past, the display of garment coordinates, which may include such items as an infant's dress and panty or a child's jacket and pants, have utilized one or more hangers designed to permit the lower garment to be supported to be visually displayed below and partially obscured within the upper covering garment. In such hanger displays, only those details of the lower garment that are exposed beyond that of the upper garment are visible to the viewer, unless the viewer physically uncovers or removes the upper garment. Thus, the attraction and sale value of the lower, partially covered, garment is lost to the viewer unless it is possible to display both coordinate elements of the garment on their separate hangers in side-by-side relationship rather than in covering relationship.

The present invention overcomes the problems of the prior art and teaches a uniquely different garment hanger system by which the user may support one or more garments to display their respective attractive details individually and in a manner that is unobscured by the other garment while permitting both garments to be supported on the same hanger system at different heights with respect to each other and at different sides of each other.

To this end, an object of the invention is to provide a monolithic garment hanger system that is of unitary molded construction having a plurality of garment hanger elements. Each hanger is intended for the supporting display of a separate article of clothing. Each hanger is also connected together by struts to form a singular integral structure in which the hangers are permitted relative articulation and movement with respect to each other to be positioned at relatively different heights for the attractive display of the features of their respectively supported garments and on opposite sides of each other.

Although it is the practice to manufacture garment hangers of lightweight plastic materials, an important consideration in the manufacture of such hangers is the cost for shipping and storing the same. Such costs are based, not on their weight, but on the space or volume that they occupy. Therefore, the cost for shipping hangers may be very high when the hangers occupy a large volume even though they may be very light in weight.

In light of the above, a feature of the present invention resides in the ability to fabricate the garment hanger system in a single molding step in which the plurality of garment hanger elements and their integral, unitarily formed articulating connecting struts, are made substantially flat. When so fabricated in a flat condition, a plurality of the garment hangers of the present invention may be readily stacked one upon the other in a compact array that occupies substantially less space and volume than prior art garment hangers. This enables the storage and shipping of large numbers of the present garment hanger system in a smaller space than has heretofore been possible for a multiple type garment hanger structure.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

Figure 1:
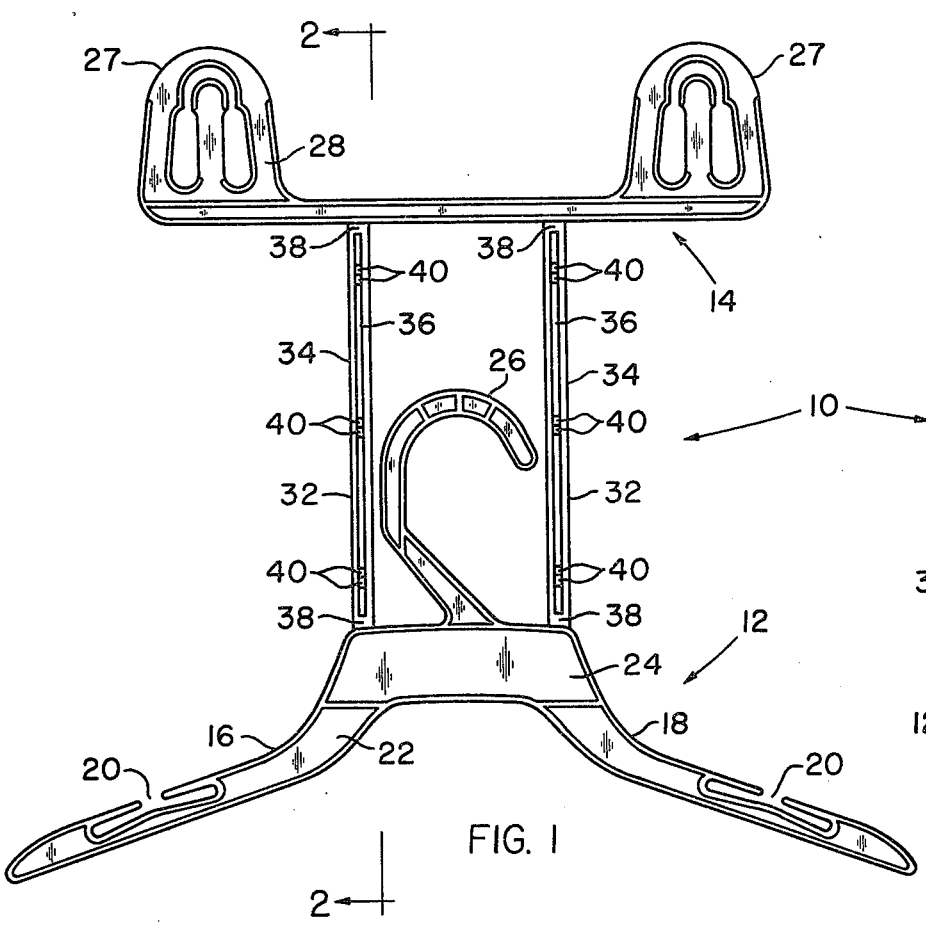
FIG. 1 is a plan view of a unitary garment hanger system constructed in its initial substantially flat molded condition according to the teaching of the present invention.
Figure 2:
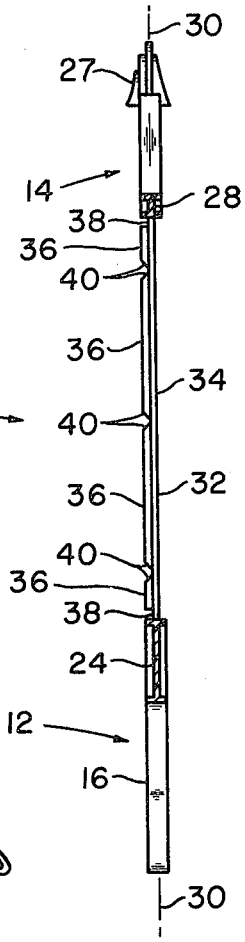
FIG. 2 is a cross-section of FIG. 1 taken along lines 2—2.
Figure 3:
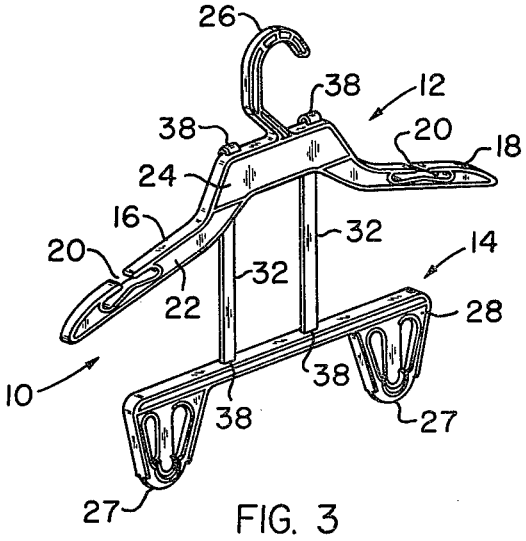
Figure 4:
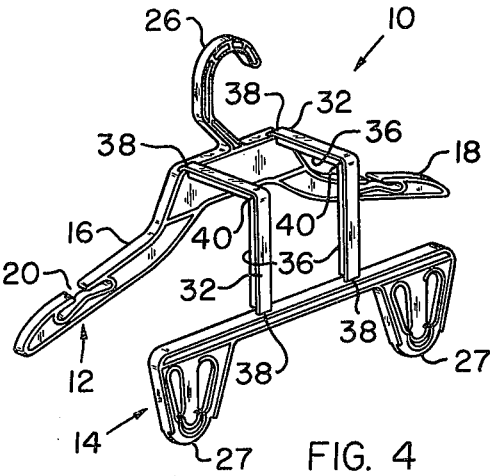
Figure 5:
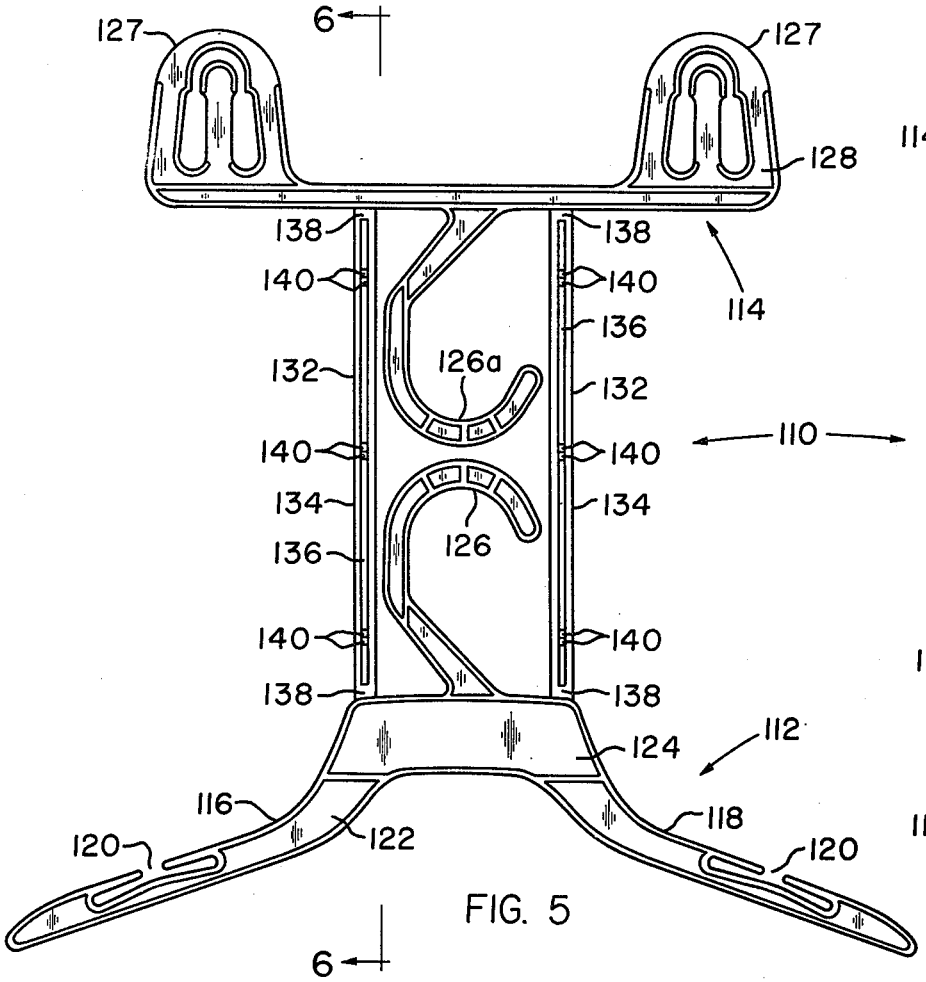
Figure 6:
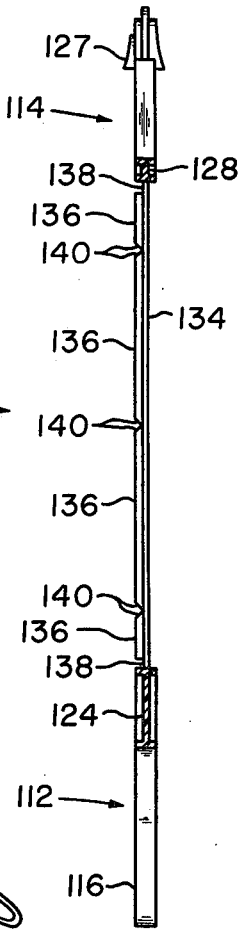
Figure 7:
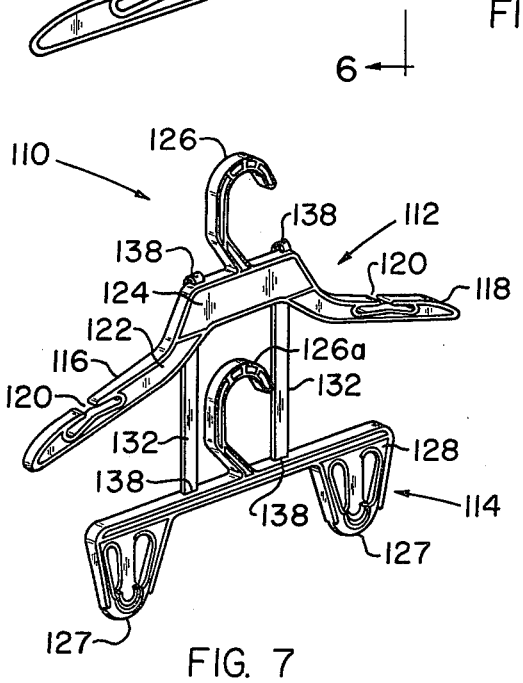

FIG. 3 demonstrates one selected relative position of articulation of the garment hanger system of FIG. 1;

FIG. 4 demonstrates another selected relative position of articulation of a garment hanger system of FIG. 1;

FIG. 5 is a plan view of another embodiment of a unitary garment hanger system in its initial substantially flat molded condition according to the teaching of the invention;

FIG. 6 is a cross-section of FIG. 5 taken along line 6—6;

FIG. 7 is a view similar to FIG. 2; and

Figure 8:
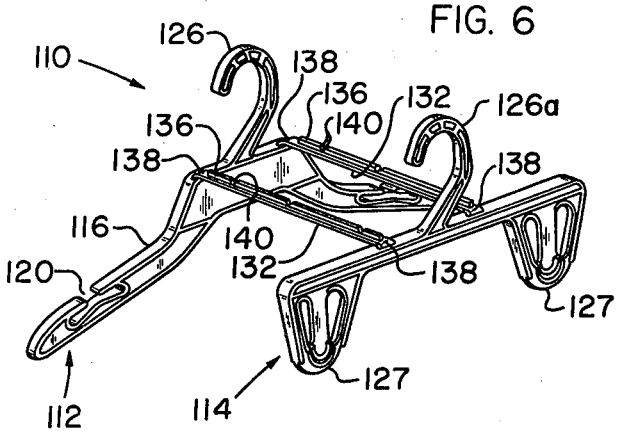

FIG. 8 demonstrates another relative position of selected articulation that the garment hanger elements may be moved into.

The embodiment of the unitary garment hanger system shown in FIGS. 1 to 4 is generally identified by the numeral 10. The same includes a plurality of garment hanger elements each of which is respectively generally identified by the numerals 12 and 14. Although the garment hanger elements 12 and 14 are shown to have specific details of construction, such details are shown and described hereinafter for convenience of understanding of the invention by the reader. It is to be understood that the specific structural details of the hangers 12 and 14 here shown are not intended to be limiting upon the scope of the invention. However, they do demonstrate that like or different hanger elements may be used in accordance with the teaching of the invention.

To enhance an understanding of the broad scope of the present invention, it is noted that the hanger 12 illustrates the use of commonly known details for supporting shouldered garments on the oppositely disposed shoulder supports 16 and 18 thereof. The shoulders 16 and 18 may have notches 20 that will support shoulder straps therein. The rigidifying I-beam border construction and closed interior is shown for convenience of explanation. Thus, the details of the garment hanger element 12 are substantially conventionally made in a molding step in which the solid body 22 fills the space between the bordering and supporting I-beam construction. The neck 24 may have a conventional garment hanger hook 26 projecting upwardly therefrom to support the system 10 from any convenient support much in the same manner as is accomplished in conventional hanger structures.

Once again for ease of understanding the broad scope of the invention, the hanger element 14 here selected for illustration is conveniently referred to as a skirt or pant hanger because such garments are readily supported from the hanger at the U-shaped clips 27 thereof. Many of the conventional details of the skirt hanger 14 are already well known in such United States Letters Patents as the Design Pat. No. 190,843 and Pat. No. 3,047,196. Hence, such specific details form no part of the present invention. However, to aid in a ready understanding, the hanger 14, like the hanger 12, lends itself to being molded of plastic material in a single molding step.

The I-beam construction of the hanger 14 is illustrated only for convenience in the same manner and for the same purpose as was discussed with respect to the hanger element 12. The body 28 filling the space between the rigidifying I-beams adds rigidity to the hanger, as is known in the trade. Both hangers 12 and 14 demonstrate they are capable of being molded along the central axial plane 30 or along any other plane substantially parallel thereto.

Molded unitary and integral with each of the plural hanger elements 12 and 14 are articulating joining means in the form of connecting struts 32. The struts 32 are constructed in T-beam formation with a base 34 and a brace or rib 36 that is shown provided on one side of the strut. Preferably, the joining or connecting strut are two in number although it is foreseeable that they may be constructed in a different arrangement than that hereshown. The struts 32 are shown to be of sufficient length or elongated extent as to be able to permit the hook 26 that is molded in planar alignment with the struts to pass between the space of the struts that connect and join together the plural hanger elements.

For convenience, the connecting means or struts 32 are molded unitary with the base or body of the two hangers at substantially the central axial plane 30. By so doing, the brace 36 defined on the one side of the base 34 remains within the lateral width or confines of the hanger elements 12 and 14 and does not project therebeyond in the manner as shown in FIG. 2. However, if the base 34 of the struts is molded more to the right of the axial plane 30 as shown in FIG. 2, the height or lateral projection of the brace 36 from the base 34 may be increased. In any event, it has been found in practice that the continuous base 34 of each connecting means or strut 32 is more conveniently molded integral with, and at the same time as the plural hanger elements, substantially along the plane 30.

Although the base 34 is continuous in its joining connection with each of the hanger elements, the articulating brace 36 provided thereon is shown to be discontinuous; that is to say, it begins at a point selectively spaced from the connecting point of each strut with the hanger elements, with such space at each strut and hanger connection being identified at the articulating or hinge at spaces 38. The hinge spaces 38, being devoid of the brace 36, enable the struts to hinge thereat and to bend readily at their points of jointure with the hanger elements 12 and 14. Also, the absence of the brace 36 at selected points along the base 34 of the struts enables the struts to be easily bent and articulated or hingedly pivoted thereat.

For this reason, and to enhance the articulating versatility of the struts 32, the braces 36 are provided on only one side thereof. However, those skilled in the art will readily realize that such bases 36, if desired, can be provided on both sides of the strut bases 34. As shown in FIG. 3, the hanger elements are unitarily molded to each other by way of the struts 32 to form a single initially flat structure. The hanger elements are susceptible of being hingedly manipulated into different positions, including one position wherein the hanger 12, having the supporting hook 26, may be disposed above the other hanger 14, and vice versa. During such manipulations of the two hangers relative to each other, the hook 26 of the hanger 12 will pass readily and handily in the space between the unitary connecting struts 32 to permit the selective positioning to be accomplished at the articulating means 38 of the struts.

For other suspended or distended types of positioning as is exemplified by the demonstration in FIG. 4, advantage is taken of the interrupted brace 36. Thus, where it is desirable to retain the skirt hanger 14 in a right angle side-by-side relationship with the hanger 12, the struts 32 are swung over the hook 26 into a position that is similar to that shown in FIG. 4. The braces 36 are interrupted along their lengths to form bevelled surfaces or termini 40 as is seen more clearly in FIG. 2. These bevelled termini or surfaces 40 may be disposed at selected angles to the base 34. In practice, when the surfaces 40 are formed at approximately 45° angles to each other, they are able to engage each other in the manner as shown in FIG. 4 to limit the amount of bending movement of the struts and hangers thereat. This permits the lower ends of the struts 32 to hang downward spaced from the connections of the struts with the hanger 14 and at an angle normal to the connection of the struts 32 with the hanger 12. At the same time the hanger 14 is retained in a lateral spaced relationship from the side of the hanger 12 as illustrated in FIG. 4.

By providing the bevelled termini surfaces 40 at selected points along the lengths of the braces 36, it is now possible to selectively space one of the hangers from the side of the other hanger and to cause the struts to assume and retain desired angular bends and/or spacing positioning of the depending hanger from that of the supporting hanger. The hanger system 10, therefore, enables a plurality of hanger elements to be positioned one above the other when it is desired to partially cover the garment on the lower hanger by a garment supported on the upper hanger. They are also able to supportingly display the whole of the garment hanger system from a rack at a single hook 26.

Upon those occasions when it is desired to display garments individually and unobscured by another garment, the garments on each of the plurality of hangers 12 and 14 may be positioned alongside and on either side of the other as is demonstrated by the various positions illustrated in FIGS. 3 and 4. When it is so desired to space the garments from each other in a side-by-side relationship as is illustrated in FIG. 4, the angular articulating retaining means in the form of the bevelled surfaces 40 may be utilized. The extent of the spacing between the hangers 14 and 12 depends upon which one of the plurality of articulating means 40 is utilized to form the bend. Hence, the spacing of one hanger from the other in normal depending relationship in the manner illustrated in FIG. 4 can be selectively controlled by selecting the proper articulating surfaces 40 for such bending function.

It is apparent that the broad concept of the present invention enables the utilization of a plurality of hanger elements of any desired construction and not just limited to those constructions here illustrated. Such hanger elements may be formed in a single plastic mold in a flat but spaced relationship as is illustrated in FIG. 1. Located between the two hanger elements 12 and 14 in the mold will be the connecting means 32 that is molded integral with the first and second hanger elements to provide a connection between the garment hanger elements and to provide for the relative movement of such garment hanger elements with respect to each other.

Thus, the two garment hanger elements 12 and 14 and the connecting means 32 are molded all at one time in a single plastic mold and molding step such that all of the structural details of the system 10 form a unitary and monolithic structure, no part of which is separate or distinct from any other part. The connecting points 38 between the connecting members 32 and the relatively spaced hanger elements provide the means by which the hanger elements may be bent with respect to the connecting means as well as with respect to each other. The braces 36 molded integral with and as a part of the connecting means 32 are provided with the bevelled articulating terminal surfaces 40 to enable the same to engage with each other and to limit the amount of bending articulation of the connecting means along its length. This permits one of the hangers to be held in suspending relationship with respect to the other hanger at any given angle, depending upon the angle of articulation of the surfaces 40, and more particularly to be held at an angle normal to the retaining struts and their connection with the other hanger element.

Thus, in its initially formed and molded arrangement as is illustrated in FIG. 1, all of the elements of the garment hanger system 10 are arranged in substantial planar alignment with each other so that they are substantially flat. This enables one hanger system 10 to be stacked upon like hanger systems 10 to enable them to fill a small volume of space with the greatest number of like garment hanger systems. This permits the storage and shipment of large numbers of the hanger system 10 in a space that is materially smaller than that presently able to be occupied by present known hanger structures.

The embodiment of the invention illustrated in FIGS. 5 through 8 inclusive is substantially like that of the invention 10 previously described. However, to enable a clearer understanding of the differences between the two embodiments, the garment hanger system of the embodiment of FIGS. 5 to 8 inclusive is generally identified by the number 110. In such embodiment, the 10's digits thereof correspond to the 10's digits of like structural elements described with respect to the garment hanger system 10 of the embodiment shown in FIGS. 1 to 4 inclusive. Therefore, a repetitious discussion of such like numbered 10's digits parts is superfluous.

Referring to the embodiment 110 of FIGS. 5 through 8 inclusive, it will be noted that the same includes two essentially individual hangers 112 and 114, each of which has its own supporting hook element 126 and **126*a*. In the prior garment hanger system 10, only one such supporting hook 26 was illustrated as connected with the hanger 12. Obviously those skilled in the art could readily have understood that the hook 26 instead of being formed as a part of the hanger 12, could have been formed just as easily as a part of the hanger 14**.

In the present embodiment 110, the hook 126 is continued as part of the hanger element 112. However, in the present embodiment, an additional hook element **126*a* is provided on the garment hanger 114. This means, therefore, that each of the garment hangers 112 and 114 are essentially capable of performing their separate functions as garment hangers, except for the fact that they are inseparately joined together in unitary monolithic relationship by the connecting means or struts 132 much in the same manner as was discussed and described in respect of the embodiment 10**.

Without embarking upon a redundant disclosure of the present invention over that of the disclosure made with respect to the embodiment 10, it can be readily seen from FIG. 7 that either one of the hanger elements 112 or 114 may be the upper hanger while the other one may perform the function of the lower hanger. Hence, although the upper hanger is illustrated as the hanger 112, it is possible that the skirt hanger 114 could be positioned above the hanger 112 and, therefore, the hanger 112 could be suspended downward from the hanger 114 by means of the connecting struts 32 hingedly bending and connecting together the two hangers at the articulating points 138 thereof. Hence, the mere illustration of the hanger 112 being positioned above the hanger 114 in FIG. 7 should not constitute a limitation upon the scope of the invention. Rather, it is suggestive of the manner by which the hangers may be hingedly moved with respect to each other by permitting the hook elements 126 and **126*a* thereof to be selectively used by passing the same through the space between the connecting articulating struts 132**.

Obviously a garment may be supported on either hanger 112 or 114, and each garment may be displayed individually in side-by-side relationship by reason of the connecting means 132. On the other hand, if desired, a shouldered garment placed upon the shouldered hanger 112 can be positioned in full or partial covering relationship over the garment supported on the hanger 114 to obscure part or all of the details of the lower garment, if so desired.

As was disclosed in connection with FIG. 4, the hanger system 110 of the present embodiment is capable of being moved into any angular position as permitted by the bevelled terminations or articulating angled surfaces 140 provided on the braces 136. Thus, a repetitious illustration of FIG. 4 in connection with the embodiment 110 is deemed to be unnecessary. However, in referring to the embodiment of FIG. 8, it will be noted that inasmuch as each of the garment hanger elements 112 and 114 has its own supporting hook 126 and **126*a* respectively, the hangers may now be hung in side-by-side connected relationship as is illustrated. This means, therefore, that the garments supported on each of the respective elements 112 and 114 will remain joined together on the unitary garment system 110** for separate display from and on their separate hangers on the same rack support.

By connecting the two garment hanger elements 112 and 114 together, even though the same are supported at their respective hooks 126 and **126*a*, the garments will be retained together as separate items of the same garment. Oftentimes one or both of the garment elements forming a part of a multipiece garment is removed from its hanger and, therefore, becomes lost or accidentally separated from its related garment. The present hanger system 110, as illustrated in FIG. 8**, permits all elements of a coordinated garment to be hung side-by-side, but in connected relationship without becoming separated from each other.

The present embodiment 110 as illustrated in FIG. 8 incorporates another feature in that each garment hanger element 112 and 114 is, in essence, a self-contained garment hanger that can be so utilized as such. Each hanger can be separated from its related garment hanger merely by cutting or severing the connecting struts 132 from one or both of the garment hanger elements 112 and/or 114. When the struts 132 are so removed from one or both of the garment hanger elements, the severed garment hanger element then, in effect, becomes an independently operable garment. This enables it to be used in the same manner as though it were initially unconnected with the system 110.

The ability to separate the hangers for independent use is a great convenience, more especially in clothing stores where, at times, it is desirable to sell one of the garments of an article of clothing separate from another garment of the same article of clothing. If the garment item that is sold is separated from that of another garment of the same article of clothing, its hanger element can be severed from the connecting struts 132 and thereafter conveniently used as a separate and individual hanger support for the garment thereon while the remaining hanger continues to function as a hanger for the garment that remains on it. Each hanger is able to function as a separate and individual hanger to be hung from any desired rack to display a garment thereon by reason of the fact that each such hanger has its own hook, such as the hook 126 or 126*a*.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

We claim:

1. A unitary molded garment hanger system comprising first and second hanger elements at least one of which has means to support said hanger system, means molded with and for unitarily joining together said first and second hanger elements permitting said first and second hanger elements movement at said joining means into different relative positions on opposite sides of each other and including means permitting adjustment of the height of one of the elements relative to the other.

2. A unitary molded garment hanger system as in claim 1, said joining means being at least an elongated strut having articulation means to permit said movements of said first and second hanger elements relative to each other and to said strut.

3. A unitary molded garment hanger system as in claim 2, a stiffening brace on said strut, said articulation means including bevelled terminations on said brace which permits bending of said strut thereat.

4. A unitary molded garment hanger system as in claim 2, said joining means being a plurality of struts each having a plurality of said articulation means enabling said hanger elements to be moved relative to each other into a plurality of garment supporting positions on opposite sides of each other.

5. A unitary molded garment hanger system as in claim 4, each said strut having a brace on one side thereof and said articulation means on each said brace including angled surfaces restricting a bending of said strut thereat to a predetermined value when said strut is bent in the direction of said brace and the bending of said strut being unrestricted when bent in the opposite direction of said articulation means.

6. A unitary hanger system comprising first and second hanger elements, each of said hanger elements having a body and garment supporting means extending from said body, connecting means formed unitary with said first and second hanger elements to enable said first and second hanger elements to be moved relative to each other at said connecting means to opposite sides of each other and including means permitting adjustment of the height of one of the hanger elements relative to the other, and a supporting hook on at least one of said hanger elements being able to be moved between said connecting means when said hanger elements are moved relative to each other.

7. A unitary hanger system as in claim 6, said connecting means including articulator means to enable the movement of one hanger element from a position aligned with the plane of the other hanger element to a position to a side of the other hanger element.

8. A unitary hanger system as in claim 6, said connecting means including articulator means providing a plurality of points of articulation along said connecting means intermediate the formation of said connecting means with said first and second hanger elements to enable said connecting means to bend thereat for adjustment of the height of a garment supported on one said hanger element relative to a garment supported on another said hanger element.

9. A unitary hanger system as in claim 8, at least one of said articulation points of said articulation means being located at the formation of said connecting means with said first and second hanger elements.

10. A unitary hanger system as in claim 6, each said hanger element having a supporting hook and each said supporting hook being movable between said connecting means when said hanger elements are moved relative to each other.

11. A unitary hanger system comprising first and second hanger elements, each of said elements including a body with garment supporting means extending therefrom, said body of at least one of said hanger elements including means supporting the unitary hanger system from a garment supporting fixture, and a set of struts extending between said bodies of said hanger elements and being formed integral and unitary therewith, and means selectively located on said struts to enable the same to bend at selected locations for raising and lowering one of said hanger elements relative to the other of said hanger elements to facilitate the display of a garment on one said hanger element at a predetermined height relative to a garment on the other hanger element, and said means including hinge means permitting movement of said hanger elements to opposite sides of each other.

12. A unitary hanger system as in claim 11, said selectively located means including means for retaining said struts in a position normal to said hanger elements.

13. A unitary hanger system as in claim 12, each of said struts including a brace, said retaining means being formed by bevelled contacting surfaces at a selected location on said brace.

14. A unitary hanger system as in claim 13, said brace extending along only one side of each strut.

15. A unitary hanger system as in claim 13, each of said struts being bendable at said retaining means of said braces to enable the adjustment of one of said hanger elements relative to the other of said hanger elements thereat, said bevelled contacting surfaces limiting a bending of said strut on the side of said brace.

16. A unitary hanger system comprising first and second hanger elements, and means formed unitary with and joining together said first and second hanger elements in a substantially flat condition, and said joining means permitting movements of said hanger elements relative to each other out of said substantially flat condition to a selected substantially side-by-side position and to positions on opposite sides of each other and including means permitting their movement to equal and different heights relative to the other.

17. A unitary hanger system as in claim 16, said first and second hanger elements and joining means forming a unitary uninterrupted structure that defines a monolithic flat pack enabling the same to be stacked one upon the other with a plurality of like ones of said unitary hanger system.

* * * * *